US011849293B2

(12) United States Patent
Pouget et al.

(10) Patent No.: US 11,849,293 B2
(45) Date of Patent: Dec. 19, 2023

(54) METHOD FOR AUTOMATED SETTING OF DIGITAL PROCESSING PARAMETERS APPLIED TO SIGNALS BEFORE BROADCAST BY LOUDSPEAKERS AND DEVICE FOR THE IMPLEMENTATION OF SUCH A METHOD

(71) Applicant: ARKAMYS, Levallois-Perret (FR)

(72) Inventors: Maël Pouget, Vayrac (FR); Guillaume Rossi Ferrari, Colombes (FR)

(73) Assignee: ARKAMYS, Levallois-Perret (FR)

( * ) Notice: Subject to any disclaimer, the term of this patent is extended or adjusted under 35 U.S.C. 154(b) by 0 days.

(21) Appl. No.: 17/650,327

(22) Filed: Feb. 8, 2022

(65) Prior Publication Data

US 2022/0256285 A1 Aug. 11, 2022

(30) Foreign Application Priority Data

Feb. 9, 2021 (FR) ..... 2101220

(51) Int. Cl.
*H04R 3/04* (2006.01)

(52) U.S. Cl.
CPC ..... *H04R 3/04* (2013.01); *H04R 2400/01* (2013.01); *H04R 2499/13* (2013.01)

(58) Field of Classification Search
None
See application file for complete search history.

(56) References Cited

U.S. PATENT DOCUMENTS 5,046,105 A * 9/1991 Bohn ..... H03G 5/12 381/98
2005/0053246 A1 3/2005 Yoshino
2008/0031471 A1* 2/2008 Haulick ..... H03G 3/32 381/86
2012/0224701 A1 9/2012 Sakai et al.

FOREIGN PATENT DOCUMENTS

CN 110913325 A * 3/2020
EP 2257083 12/2010

OTHER PUBLICATIONS

CN-110913325 English machine translation (Year: 2020).*

* cited by examiner

*Primary Examiner* — James K Mooney
(74) *Attorney, Agent, or Firm* — Perman & Green, LLP

(57) ABSTRACT

A method for automated setting of digital processing parameters intended to be applied to digital signals before broadcast by at least one loudspeaker placed in an environment. The method includes a step of determining a set of frequency responses of the environment, an equalization step applied for each subset of at least one loudspeaker and a second equalization step applied to at least one subset of at least one loudspeaker. A device for the implementation of the method is also provided.

8 Claims, 4 Drawing Sheets

[Fig. 1]
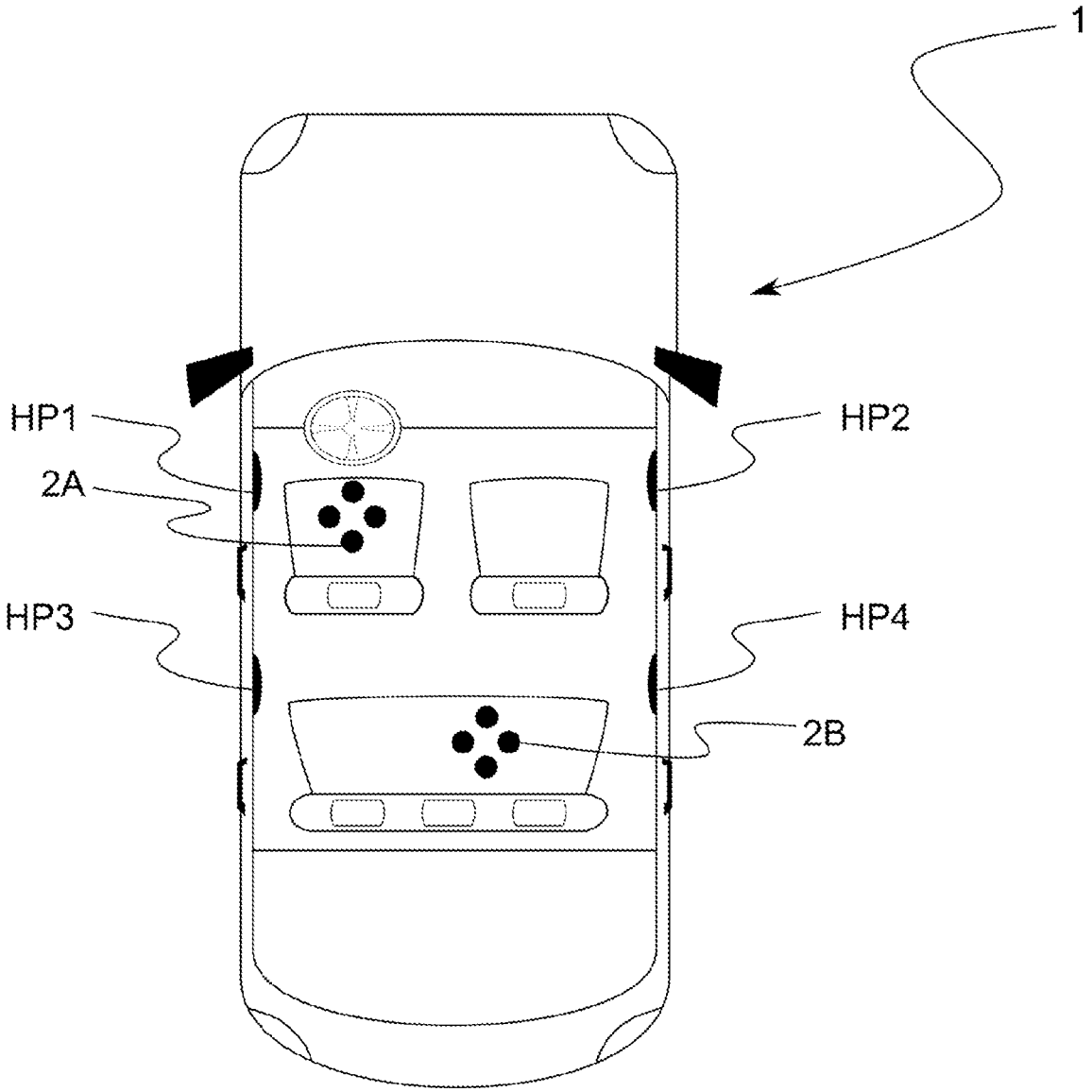

[Fig. 2]
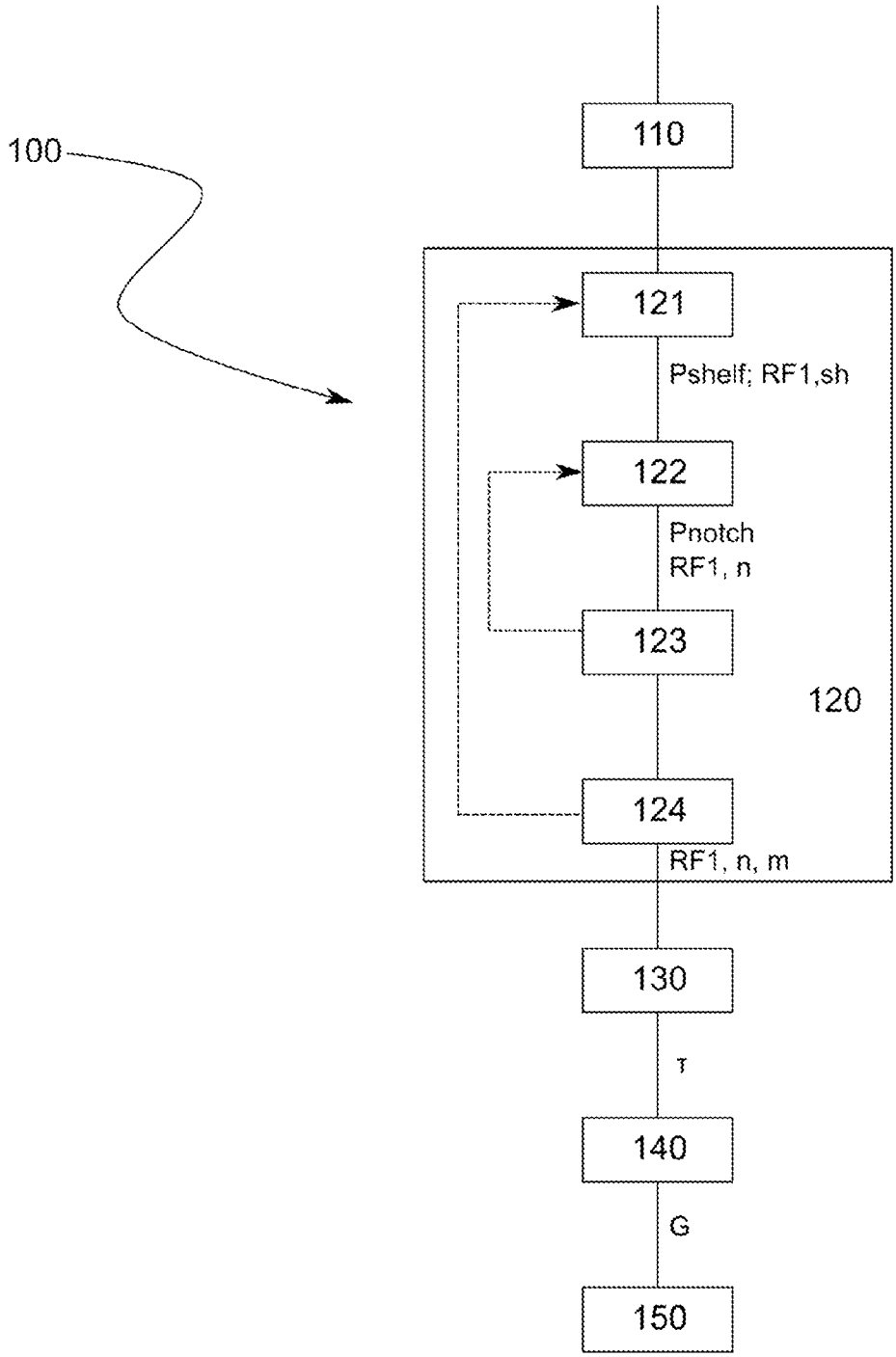

[Fig. 3A]
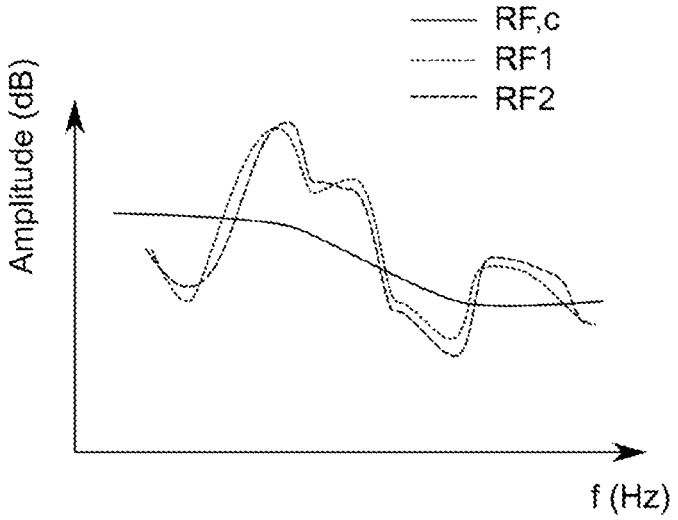
[Fig. 3B]
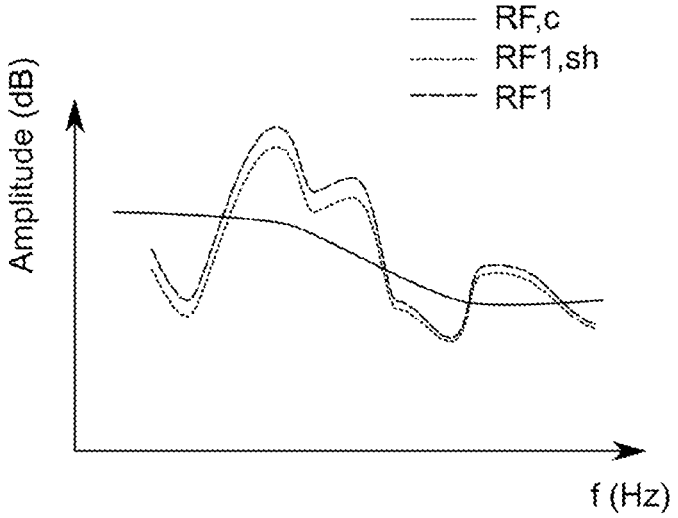
[Fig. 3C]
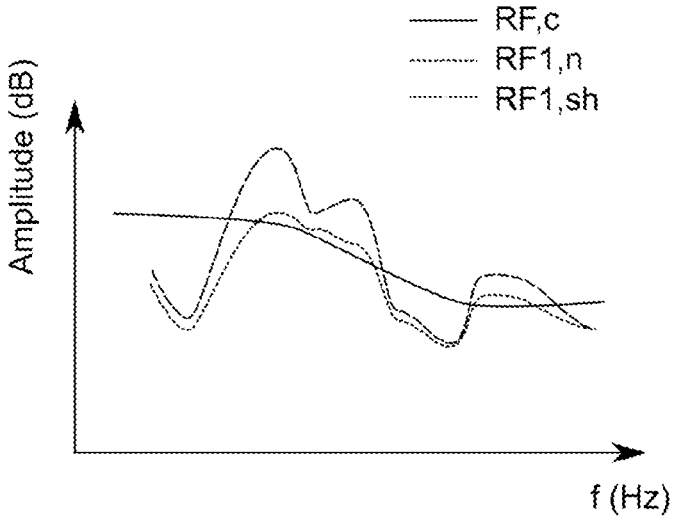

[Fig. 3D]
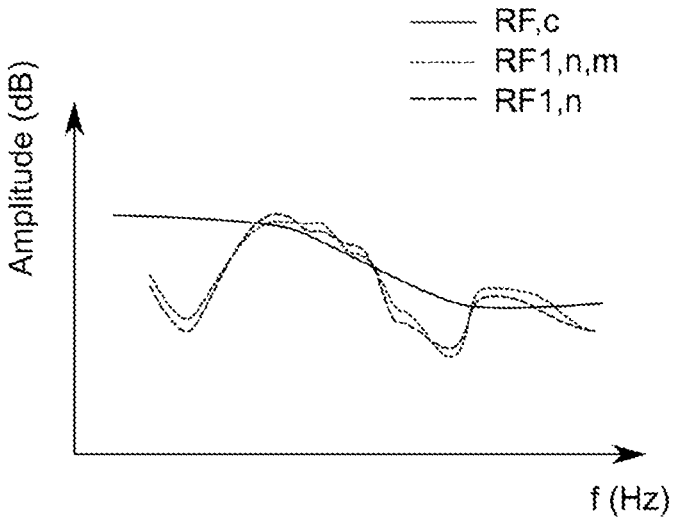
[Fig. 4]
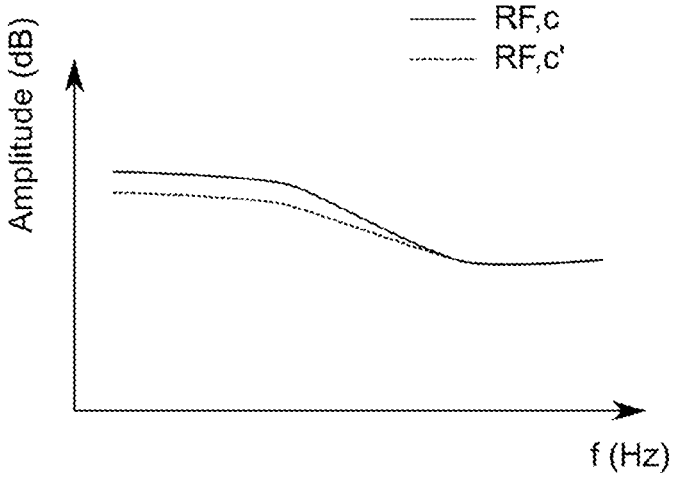

METHOD FOR AUTOMATED SETTING OF DIGITAL PROCESSING PARAMETERS APPLIED TO SIGNALS BEFORE BROADCAST BY LOUDSPEAKERS AND DEVICE FOR THE IMPLEMENTATION OF SUCH A METHOD

CROSS-REFERENCE TO RELATED APPLICATIONS

This application claims priority to and the benefit of French patent application number FR 2101220 filed on Feb. 9, 2021, the disclosure of which is incorporated herein by reference in its entirety.

BACKGROUND

1. Field

The present disclosure relates to the field of sound signal processing.

More particularly, the present disclosure relates to a method for automated setting of signal processing parameters applied to signals broadcast by means of loudspeakers located in a given environment and a device for the implementation of such a method.

The present disclosure finds a particular application in the automotive field, and in particular in the definition of a soundscape in a passenger compartment of a vehicle.

2. Brief Description of Related Developments

In general, filter parameters to be applied to the loudspeakers of a vehicle to obtain a given soundscape in a car are manually adjusted by an operator, the soundscape being assessed "by ear" by the operator who adjusts the parameters according to what he perceives.

A method and a system for automated acoustic equalisation are known from the prior art. The European patent EP 3 111 667 discloses a method allowing providing an equalisation of a signal by determining filter parameters to be applied at the input of the loudspeakers allowing reducing the deviation between the amplitude of a frequency response of the environment of the loudspeakers and a target frequency response.

SUMMARY

The present disclosure relates to a method for automated setting of digital processing parameters intended to be applied to digital signals before broadcast by at least one loudspeaker placed in an environment. An advantage of the present disclosure is that it allows for a more complete and more accurate setting of the digital processing parameters in comparison with the prior art.

The present disclosure relates to a method for automated setting of digital processing parameters intended to be applied to digital signals before broadcast by at least one loudspeaker placed in an environment. According to the present disclosure, the method includes the following steps:

- a step of determining a set of frequency responses of the environment, each of the frequency responses being determined by activating a subset of at least one loudspeaker;
- an equalisation step applied for each subset of at least one loudspeaker, during which filter parameters to be applied to the at least one loudspeaker of each subset are determined so as to minimise a deviation between a predetermined target frequency response and the frequency response associated to the subset of at least one loudspeaker determined during the step of determining a set of frequency responses;
- a second equalisation step applied to at least one subset of at least one loudspeaker, to determine filter parameters to be applied to said loudspeakers so as to attenuate over a set of frequencies to be corrected the frequency response of the environment obtained when all loudspeakers are active.

In one implementation, the equalisation step, applied to a subset of at least one loudspeaker, includes the following substeps:

- a substep of applying a shelf filter during which is determined a shelf filter to be applied to the at least one loudspeaker to minimise a deviation between the frequency response curve determined during the step of determining a set of frequency responses and the target frequency response;
- a curve adjustment substep during which parameters of band-reject filters are determined to minimise a deviation between the frequency response curve determined during the substep of applying a shelf filter and the target frequency response;
- an optimisation substep during which the reject filters are sorted by means of criteria applied to the parameters of said filters;
- a verification step during which the frequency response of the environment is measured by applying to the subset of the at least one loudspeaker the band-reject shelf filters determined during the previous substeps, and during which the measured frequency response is compared with the theoretically expected frequency response after the optimisation substep.

In one implementation, the number of band-reject filters used during the curve adjustment substep is at least equal to the number of local maxima of the frequency response curve obtained upon completion of the substep of applying a shelf filter.

In one implementation, the band-reject filters are suppressed during the optimisation substep if they have a gain higher than a threshold maximum gain G_th_max and a quality factor lower than a threshold minimum quality factor Q_th_min.

In one implementation, the method according to the present disclosure further includes:

- a phase-shift step during which at least one delay r is applied to at least one subset of at least one loudspeaker;
- a step of applying a gain to at least one subset of at least one loudspeaker.

In one implementation, the at least one delay is determined by means of M measurements carried out at a reference point or in a vicinity of said reference point as being the whole fraction $(k \times \tau max)/M$ allowing maximising energy over a frequency band determined beforehand, with k an integer comprised between 1 and M, and $\tau max$ referring to a maximum delay.

In one implementation, the considered frequency band comprises the frequency band [70 Hz; 120 Hz].

In one implementation, during the second equalisation step, a secondary target frequency response curve RF,c' is determined as follows:

$$RF, c'(f) = \begin{cases} 2RF, c(f) - RF(f) \text{ if } RF(f) - RF, c(f) \geq S \\ RF, c(f) \text{ otherwise} \end{cases} \quad \text{[Math 1]}$$

where f refers to the frequency, RF the frequency response measured with all loudspeakers being active, the filter parameters determined at the equalisation step, as well as the at least one delay and the gain determined at the phase-shift and gain application steps being applied to the sine sweep type signals broadcast by the loudspeakers, and S referring to a positive threshold value.

In one implementation, during the step of determining a set of frequency responses, said frequency responses are determined by means of at least one set of at least one microphone, said responses being averaged over each of the sets of microphones.

The present disclosure also relates to a device for automated setting of digital processing parameters intended to be applied to digital signals before broadcast by at least one loudspeaker placed in an environment. According to the present disclosure, the device includes:

means for determining a set of frequency responses of the environment, each of the frequency responses being determined by activating a subset of at least one loudspeaker;

means for determining, for each subset of at least one considered loudspeaker, filter parameters to be applied to the at least one loudspeaker so as to minimise a deviation between a predetermined target frequency response and the frequency response associated to the subset of at least one loudspeaker.

BRIEF DESCRIPTION OF THE FIGURES

FIG. 1 represents a vehicle passenger compartment comprising loudspeakers and in which microphones are positioned at the driver seat and at the rear seat to carry out a set of frequency response measurements.

FIG. 2 represents a schematic diagram of the method according to the present disclosure.

FIG. 3A represents the frequency spectra of a target frequency response and of two frequency responses measured in the vehicle.

FIG. 3B represents the frequency spectra of a measured frequency response and of this same frequency response to which a "shelf" type filter is applied.

FIG. 3C represents the frequency spectra of a measured frequency response to which a "shelf" type filter is applied and of this same frequency response after application of the band-reject type filters.

FIG. 3D represents the frequency spectra of a theoretical frequency response obtained after application of the "shelf" and band-reject type filters and a frequency response measured in the passenger compartment of the vehicle with the application of the determined filters by means of the method according to the present disclosure.

FIG. 4 represents the target frequency response and the secondary target frequency response.

DETAILED DESCRIPTION

The present disclosure relates to a method 100 for automated setting of filter parameters applied to loudspeakers located in a given environment.

For illustration, as illustrated in FIG. 1, the environment considered in the following description is a vehicle passenger compartment 1. This example does not limit the present disclosure which could be implemented in other types of environments, for example a performance hall.

It is herein considered a set of four loudspeakers, including two front loudspeakers HP1, HP2 disposed in left and right front doors of the vehicle 1, and two loudspeakers HP3, HP4 disposed at the left and right rear doors of said vehicle. A person skilled in the art will understand that the present disclosure could apply to a different number of loudspeakers.

With reference to FIG. 2, a first step of the method 100 consists in determining a set of frequency responses 110 of the passenger compartment of the vehicle.

By "frequency response", it should be understood the frequency response of the passenger compartment of the vehicle to a sine sweep type time signal.

In the illustrated example, the frequency response is determined by means of a set of four microphones 2A disposed at the driver seat of the passenger compartment, or by means of a set of four microphones 2B disposed at the rear, at a passenger seat. The set of microphones that is used (front or rear) depends on the loudspeakers that are used, as it will be understood later on. The measurements obtained at the microphones of one set of microphones (front or rear) are averaged to obtain an average frequency response on said set. Thus, such an averaging allows smoothing the measurements and reducing the impact of possible measurement errors and/or uncertainties.

A person skilled in the art will understand that any number of microphones could be used.

A first frequency response RF1 is determined by means of an averaging of the measurements originating from the four microphones by broadcasting the sine sweep type signal in the two loudspeakers HP1, HP2 located at the front, the two loudspeakers located at the rear being inactive. To measure the first frequency response RF1, the set of microphones placed at the front is used.

Afterwards, a second frequency response RF2 is determined by means of an averaging of the measurements originating from the four microphones by broadcasting the sine sweep type signal in the two loudspeakers HP3, HP4 located at the rear, the two loudspeakers located at the front being inactive. To measure the first frequency response RF2, the set of microphones placed at the rear is used.

Thus, upon completion of the step of determining a set of frequency response 110, a set of two frequency responses RF1, RF2 is determined as illustrated in FIG. 3A.

Afterwards, during a second step of the method 100, a first equalisation 120 is carried out. The objective of this step is to determine a set of filters Hi to be applied to the signals broadcast by the loudspeakers HP1, HP2, HP3, HP4 of the vehicle to better approach a target frequency response RF,c, which is a frequency response defined prior to the method, for example in a set of specifications.

For simplicity, only the determination of filters to be applied to the front loudspeakers HP1, HP2 is considered later on, bearing in mind that the determination of the filters to be applied to the rear loudspeakers HP3, HP4 is similar.

Hence, the equalisation step 120 is applied only with the front HP1, HP2 (respectively rear HP3, HP4) loudspeakers turned on for the determination of the filters to be applied to the front HP1, HP2 (respectively rear HP3, HP4) loudspeakers For the determination of the filters to be applied to the front loudspeakers HP1, HP2, the first frequency response RF1 is considered.

For the determination of the filters to be applied to the rear loudspeakers HP3, HP4, the second frequency response RF2 is considered.

The equalisation step 120 includes a first substep of applying a "shelf" type filter Hshelf 121. The nature of the filter Hshelf depends on the tonal balances of the first frequency response RF1 (respectively of the second frequency response RF2) and of the target frequency response RF,c. Thus, the filter Hshelf may be of the "high-shelf" or "low-shelf" type depending on the tonal balance of these curves.

By "tonal balance", it should be understood the aspect of the amplitude curve as a function of frequency.

In any case, the used shelf filter Hshelf allows minimising a deviation between the frequency response RF1 (respectively frequency response RF2) and the target frequency response RF,c. For example, this deviation could be characterised by two parameters: a distance between the curves calculated via the root mean square of the difference between the two curves, and an evenness index corresponding to the derivative of the difference between said curves.

For example, a low-shelf filter may be preferred if a deviation between the frequency response RF1 (respectively frequency response RF2) and the target frequency response RF,c is more significant in the low frequencies than in the high frequencies. Conversely, a high-shelf type filter may be preferred.

Upon completion of this substep of applying the shelf filter 121, are obtained:

- a set of parameters Pshelf comprising for example the frequencies of the pole and of the zero of the shelf filter;
- a modified frequency response RF1,sh, as illustrated in FIG. 3B.

Afterwards, the equalisation step 120 includes a second curve adjustment substep 122 during which band-reject filters Hnotch ("notch filter") are determined.

In an implementation of the method of the present disclosure, there are at least as many band-reject filters Hnotch as local maxima on the frequency response curve RF1,sh as obtained upon completion of the substep of applying the shelf filter 121, each band-reject filter Hnotch imparting a decrease of the amplitude of the frequency response over a frequency band around a central frequency fc.

It should be noted that band-pass filters could also be determined during this step. Nonetheless, their use is avoided in order to avoid the amplification of the noise included in the broadcast signal.

Hence, each frequency associated to a local maximum belongs to a frequency band targeted by one of the band-reject filters Hnotch.

Upon completion of this curve adjustment substep 122, are obtained:

- a set of parameters Pnotch of the band-reject filters Hnotch allowing minimising a deviation between the frequency response RF1,sh obtained following the previous substep and the target frequency response RF,c. As mentioned before, this deviation may for example be characterised by two parameters: a distance between the curves calculated via the root mean square of the difference between the two curves, and an evenness index corresponding to the derivative of the difference between said curves;
- a modified frequency response RF1,n, as illustrated in FIG. 3C.

For example, the parameters Pnotch comprise quality factors Qnotch, gains Gnotch, central frequencies fc.

Afterwards, the equalisation step 120 includes an optimisation substep 123. The parameters of the filters obtained during the curve adjustment substep 122 may be such that the presence of some band-reject filters Hnotch actually turns out to be barely useful, and even be detrimental to the obtainment of an optimum result.

During the optimisation substep 123, the reject filters are sorted by means of criteria applied to the parameters of said filters.

In one implementation, these criteria are predefined ahead, but they could also be set by an operator at this level of the method and could possibly be defined dynamically.

As a non-limiting example, the filters may be suppressed if they have a bad gain/quality factor pair, i.e. a significant gain higher than a threshold maximum gain G_th_max and a slightly high quality factor, lower than a threshold minimum quality factor Q_th_min. Indeed, for a significant gain associated to a low quality factor, the filters might act accordingly on one or several frequency band(s) already controlled by one or several other filter(s). As a non-limiting example, the threshold maximum gain G_th_max amounts for example to 7 dB, and the threshold minimum quality factor Q_th_min is equal to 2. These threshold values depend on the desired quality during the equalisation step 120.

In the case where some filters have been suppressed upon completion of this optimisation substep 123, it is again proceeded with the curve adjustment substep 122, all of the parameters of the filters that have not been suppressed are then readjusted. Afterwards, it is again proceeded with the optimisation substep 123, until it is considered that all used filers are well relevant with regards to the criteria set up during said optimisation substep. Hence, the curve adjustment 122 and optimisation 123 substeps are implemented as many times as necessary until the filters define a relevant set meeting the above-mentioned criteria.

Of course, in the case where band-pass filters have been implemented before, some could also be suppressed where necessary, based on similar criteria.

The conditional nature of the return to the curve adjustment substep 122 is symbolised in FIG. 2 by an arrow in broken line connecting the optimisation substep 123 to the curve adjustment substep 122.

In one implementation, the parameters Pshelf determined during the substep of applying a shelf filter 121 are also tested to ascertain the interest of the determined shelf filter Hshelf. In this case, the substep 121 could also be implemented again.

It could be considered that the measured carried out during the step of determining the frequency responses 110 of the vehicle are distorted, because of the presence of a noise signal that occurred during the measurements.

The noise signal may originate from various sources. It may consist of a continuous or punctual signal, and may be inside or outside the vehicle. For example, it may consist of a wind blow, a door slam, or non-linearities resulting in harmonics, for example a vibration of elements inside the vehicle such as a vibration of the doors or of mobile elements of the loudspeakers.

Such a noise signal modifies the amplitude of some frequencies to the extent that the frequency response determined at the step of determining a set of frequency responses 110. The shelf filter application 121, curve adjustment 122 and optimisation 123 substeps being based on the measured frequency response, the noise signal is therefore taken into account when determining the filters.

In the presence of a noise signal, the determination of the filters could therefore be distorted, since:

- if the noise signal is punctual, the filters will act by integrating this noise signal which has disappeared after the measurement;
- in the presence of a continuous signal or of non-linearities, the actions of the filters on the frequencies related to the noise will be limited and even zero, because the considered frequency components are either independent of the acoustics of the vehicle, or harmonics generated by a fundamental with a lower frequency.

Hence, it is proceeded with a verification substep 124 during which new measurements of frequency responses are carried out according to the same principle as step 110 of determining the frequency responses, yet while filtering the signals with the filters determined during the previous substeps 121, 122, 123 of the equalisation step 120. As regards the front loudspeakers, the measurements will be carried out while using the filters determined from the first frequency response RF1. As regards the rear loudspeakers, the measurements will be carried out while using the filters determined from the second frequency response RF2.

With reference to FIG. 3D, it is thus obtained, by averaging the signals obtained on all of the microphones placed at the front 2A (respectively at the rear 2B), a measured frequency response curve RF1,n,m, which is compared with the theoretical curve RF1,n deduced from the parameters determined during the previous substeps and the first frequency response RF1 measured during the step of determining a set of frequency responses 110. In the case where significant deviations are noticed between the two curves, the shelf filter application 121, curve adjustment 122 and optimisation 123 substeps are implemented again with the newly measured frequency response curve RF1,n,m in order to compensate for the errors.

The conditional nature of a new implementation of these substeps is symbolised in FIG. 2 by an arrow in broken line connecting the verification substep 124 to the substep of applying a shelf filter 121.

The significance of the amplitude deviations between the measured and theoretical curves could be assessed by means of predefined criteria, for example a deviation could be considered as being significant if it is higher than or equal than 3 dB. These criteria could also be variable according to the frequency.

Advantageously, the new measured frequency response curve RF1,m is compared with the frequency response RF1 measured during step 110 of determining the frequency responses, in order to identify potential frequencies or frequency bands that are not or barely attenuated despite the action of the filters; these potential frequencies or frequency bands reveal a noise signal on which it is not possible to act by means of the filters (non-linearities or external noise for example). If such frequencies are identified, they will be ignored during a potential new implementation of the shelf filter application 121, curve adjustment 122 and optimisation 123 substeps.

As specified hereinabove, the equalisation step 120 is applied separately to the front loudspeakers HP1, HP2 and to the rear loudspeakers HP3, HP4, the first frequency response RF1 being considered in the first case, and the second frequency response RF2 being considered in the second case.

In the illustrated implementation, the method 100 includes a third step 130 of phase-shifting the rear loudspeakers HP3, HP4.

Because of the different distances of each of the loudspeakers at the driver seat (considered as a reference point in the implementation of the method described herein), phase-shifts appear between the signals broadcast by each of the loudspeakers when the broadcast signals reach the driver seat. A drawback of these phase-shifts is that there is thus a risk of obtaining destructive interferences between the signals, resulting in a low useful signal level received by the driver, which useful signal level might be insufficient to hide a noise-type signal.

In order to avoid this, during the phase-shift step 130, a delay is applied to the signals broadcast by the rear loudspeakers HP3, HP4 and a signal level received at the driver seat is measured, by means of one or several microphone(s).

In a preferred implementation, M measurements are carried out for a discrete set T of delays τ comprised within an interval [0; τmax], for example with $$T = \left\{ k\frac{\tau\max}{M};\ k \in [\![1; M]\!] \right\} \qquad \text{[Math 2]}$$

Where [[1; M]] refers to all integers comprised between 1 and M.

The maximum delay τmax should not be too significant for the driver not to perceive an echo feeling because of a too significant delay that would have been applied to the rear loudspeakers. For example, it could correspond to the time required by sound to cover a 1-meter-distance in air, i.e. to be equal to 1/Vs, where Vs refers to sound velocity in air.

Upon completion of this phase-shift step 130, is retained a delay r allowing maximising energy over a frequency band given beforehand and set by specifications. For example, this frequency band may correspond to the frequency band [70; 120 Hz].

In an alternative implementation, a different delay is retained for each of the rear loudspeakers in order to take into account the respect location of the two rear loudspeakers with respect to the driver seat.

During a subsequent step 140 of the implementation of the illustrated method 100, a gain G is applied to the signals broadcast by the loudspeakers placed at the front, in order to give the driver the feeling that the "auditory scene", or origin of the sound, is at the front.

For this purpose, two measurements are carried out during the step 140 of applying a gain.

A first measurement is carried out at the front, by means of the set of microphones disposed at the front, with the loudspeakers disposed at the front being the only active loudspeakers. The signals measured on the four microphones are averaged. For example, the signal used for the measurement is a sine sweep type time signal.

A second measurement is carried out at the rear, by means of the set of microphones disposed at the rear, with the loudspeakers disposed at the rear being the only active loudspeakers. The signals measured on the four microphones are averaged. For example, the signal used for the measurement is a sine sweep type time signal.

Afterwards, a difference in levels measured between the obtained front and rear averaged signals is determined, for example by calculating a difference in acoustic intensity levels between the averaged signals.

Afterwards, the gain G is applied according to the noticed difference, in order to approach a target deviation which may amount for example to 2 dB. In this example, if a level difference of 1 dB is observed, a 1 dB gain is thus applied to the signals broadcast in the front loudspeakers in order to obtain a level difference of 2 dB.

Of course, the value of the target deviation may be different from 2 dB.

Similarly, the measurement protocol implemented during this step 140 of applying a gain may be different, for example, it is possible to consider carrying out these two same measurements while activating, in each case, only the rear loudspeakers.

Also, it is possible to consider applying the gain G to other loudspeakers, in particular to displace the auditory scene, for example said gain could be applied to the loudspeakers placed at the rear for an impression of an auditory scene at the rear of the vehicle.

It is also possible to consider applying a set of different gains according to the loudspeakers.

During a subsequent step of the method 100, a second equalisation 150 is applied. The objective of this second equalisation is to assess the quality of the signal obtained with all loudspeakers being turned on, and to intervene from a frequency perspective on one or several signal(s) respectively originating from one or several loudspeaker(s).

To the extent that the equalisation herein favours the reject filters, in a preferred implementation of the present disclosure, the equalisation is applied to the loudspeakers to which no gain has been applied during step 140. Hence, in the example of an auditory scene at the front, the equalisation is applied to the rear loudspeakers, in order to keep the impression of an "auditory scene" at the front of the vehicle established during the previous step. Indeed, in the case where only reject filters are implemented, carrying out the equalisation on the front loudspeakers would indeed lead to a reduction of the deviation between the levels at the front and at the rear and therefore would tend to reduce the impression of an auditory scene at the front. Nonetheless, it is possible to carry out this equalisation on other loudspeakers, in particular if band-pass filters are used.

For this purpose, with reference to FIG. 4, a secondary target frequency response RF,c' is defined which substantially has a profile similar to that of the target frequency response RF,c, but for which a lower amplitude is desired in the low frequencies. This lower amplitude in the low frequencies allows compensating on the one hand for the low frequencies that have been amplified or which have appeared during the phase-shift step 130, as well as for those amplified by superimposition of all of the loudspeakers. For example, the secondary target frequency response RF,c' has a frequency band ranging from 20 Hz to 200 Hz attenuated by G decibels in comparison with the target frequency response RF,c, G being the gain applied during the previous step. Of course, the attenuated frequency band and/or the attenuation may be different.

The secondary target frequency response RF,c' is adapted to take into account the effect of superimposition of the loudspeakers and of steps 130 and 140 of phase-shifting and of applying a gain over the frequency spectrum, and to compensate for the amplified frequencies, in particular in the low frequencies. In particular, the secondary target frequency response RF,c' aims to limit the energy output by the rear loudspeakers in comparison with the front loudspeakers (which are favoured for an auditory scene at the front, but the principle is the same for an auditory scene placed at the rear).

The determination of the secondary target frequency response RF,c' is carried out by broadcasting in all of the four loudspeakers HP1, HP2, HP3, HP4 a sine sweep type signal, the filter, delay and gain parameters determined before being applied to the loudspeakers, and by measuring a frequency response RF by means of the four front microphones 2A disposed at the driver seat. The frequency response RF thus obtained is compared with the target frequency response RF,c.

For example, the secondary target frequency response RF,c' may be defined according to the relationship:

$$RF,c'(f) = \begin{cases} 2RF,c(f) - RF(f) \text{ if } RF(f) - RF,c(f) \geq S \\ RF,c(f) \text{ otherwise} \end{cases} \quad \text{[Math 3]}$$

where f refers to the frequency, RF the frequency response measured by the microphones, and S a strictly positive threshold value, expressed in decibels. In one implementation, S is equal to 1 dB.

In other words, if the energy output by the rear loudspeakers is too pronounced in comparison with the energy output by the front loudspeakers alone, the target frequency response is adapted to limit the contribution of the rear loudspeakers at the considered frequencies.

Once defined, the secondary target frequency response RF,c', the equalisation step 120 is applied again to define new filter parameters, but only to set filter parameters of the rear loudspeakers, and with the secondary target frequency response RF,c'. Hence, this new application of the equalisation step is based on a new frequency response measurement, at the rear microphones 2B, with the rear loudspeakers being the only active loudspeakers.

The reason for which this step is applied only to the rear loudspeakers is to keep the impression of an auditory scene at the front. Of course, if this constraint is not retained, the equalisation step 120 could herein be applied also to the front loudspeakers alone or to any other subset of loudspeakers.

During the second equalisation step 150, the equalisation step is thus implemented in different conditions in terms of active loudspeakers and of frequency response objective.

Upon completion of the method, a set of signal processing parameters is thus obtained, including filter parameters such as quality factor, gain, central frequencies, one or several delay(s), a gain to be applied to the signals broadcast in the loudspeakers disposed in the passenger compartment of the vehicle, in order to obtain a frequency response of the passenger compartment of the vehicle minimising a deviation with a target frequency response defined for example in a specification. For example, this deviation could be characterised by two parameters: a distance between the curves calculated via the root mean square of the difference between the two curves, and an evenness index corresponding to the derivative of the difference between said curves.

The determination of all of the signal processing parameters is done automatically, provided that:

- the target frequency response RF,c and the secondary target frequency response RF,c' have been specified;
- the criteria used during the optimisation substep 123 have been defined.

In one implementation, the target frequency response RF,c and the criteria used during the optimisation substep 123 are defined prior to the implementation of the method.

In an alternative implementation, these elements are defined as the method progresses, by an operator.

Of course, although the front of the vehicle is preferred throughout the method described herein, a person skilled in the art will understand that the method could also be implemented to displace the "auditory scene" to the rear of the vehicle or on the sides.

In particular, instead of considering as a reference the driver seat, it is possible to consider as a reference a passenger sear, or any point inside the passenger compartment of the vehicle.

In the implementation described hereinabove, the front and rear loudspeakers have been considered separately. A person skilled in the art will understand that, during the implementation of the method, other combinations of loudspeakers may be considered.

As example, during the step of determining a set of frequency responses 110, a set of four frequency responses could for example be established by activating loudspeakers one after another. In another implementation, the left front loudspeaker could be considered alone and the other loudspeakers could be considered together. In another implementation, the left loudspeakers could be considered separately from the right loudspeakers, the favoured auditory scene being the left side of the passenger compartment.

Also, two distinct secondary target frequency responses may also be considered during the second equalisation step 150, to proceed with a new equalisation of the front and rear loudspeakers.

The present disclosure also relates to a device for the implementation of the method according to the present disclosure, including:

means for determining a set of frequency responses of a given environment comprising loudspeakers, the environment being for example a vehicle passenger compartment;

means for determining a set of digital processings to be applied to the signals to be broadcast via the loudspeakers to minimise a deviation between a frequency response of the environment and a target frequency response of said environment.

The means for determining a set of frequency responses comprise in particular a sound source adapted to output a "sine sweep" type signal as well as a set of one or several microphone(s).

In particular, the digital processings comprise filters, for example of the "shelf", band-reject, or band-pass type, as well as one or several gain(s), the application of one or several delay(s).

What is claimed is:

1. A method for automated setting of digital processing parameters intended to be applied to digital signals before broadcast by at least one loudspeaker of a plurality of loudspeakers placed in an environment, said method being characterised in that it includes the following steps:

a step of determining a set of frequency responses of the environment, each of the frequency responses being determined by activating a respective subset of said plurality of loudspeakers;

a first equalisation step applied for each respective subset, during which filter parameters to be applied to the loudspeakers of each respective subset are determined so as to minimise a deviation between a predetermined target frequency response and the frequency response associated to each respective subset of loudspeakers determined during the step of determining a set of frequency responses;

a second equalisation step applied to at least one subset, to determine filter parameters to be applied to said plurality of loudspeakers so as to attenuate over a set of frequencies to be corrected the frequency response of the environment obtained when all loudspeakers are active;

a phase-shift step during which at least one delay $\tau$ is applied to the at least one subset; and a step of applying a gain to the at least one subset;

wherein during the second equalisation step, a secondary target frequency response curve RF,c' is determined as follows:

$$_RF, c'(f) = \begin{cases} 2RF, c(f) - RF(f) \text{ if } RF(f) - RF, c(f) \geq S \\ RF, c(f) \text{ otherwise} \end{cases}$$

where f refers to the frequency, Rf,c is the target frequency response, RF the frequency response measured with all loudspeakers being active, the filter parameters determined at the first equalisation step, as well as the at least one delay $\tau$ and the gain determined at the phase-shift and gain application steps being applied to sine sweep type signals broadcast by the plurality of loudspeakers, and S referring to a positive threshold value.

2. The method according to claim 1, characterised in that the first equalisation step, applied to each subset of loudspeakers, includes the following substeps:

a substep of applying a shelf filter during which is determined a shelf filter to be applied to the loudspeakers of each respective subset to minimise a deviation between the frequency response curve determined during the step of determining a set of frequency responses and the target frequency response;

a curve adjustment substep during which parameters of band-reject filters are determined to minimise a deviation between the frequency response curve determined during the substep of applying a shelf filter and the target frequency response;

an optimisation substep during which the reject filters are sorted by means of criteria applied to the parameters of said filters; and a verification step during which the frequency response of the environment is measured by applying to the loudspeakers of each respective subset the band-reject shelf filters determined during the previous substeps, and during which the measured frequency response is compared with the theoretically expected frequency response after the optimisation substep.

3. The method according to claim 2, characterised in that the number of band-reject filters used during the curve adjustment substep is at least equal to the number of local maxima of the frequency response curve obtained upon completion of the substep of applying a shelf filter.

4. The method according to claim 2, characterised in that the band-reject filters are suppressed during the optimisation substep if they have a gain higher than a threshold maximum gain and a quality factor lower than a threshold minimum quality factor.

5. The method according to claim 1, characterised in that the at least one delay is determined by means of M measurements carried out at a reference point or in a vicinity of said reference point as being the whole fraction $(k \times \tau max)/M$ allowing maximising energy over a frequency band determined beforehand, with k an integer comprised between 1 and M, and $\tau max$ referring to a maximum delay.

6. The method according to claim 5, characterised in that the considered frequency band comprises the frequency band [70 Hz; 120 Hz].

7. The method according to claim 1, characterised in that, during the step of determining the set of frequency responses, said frequency responses are determined by means of at least one set of at least one microphone, said responses being averaged over each of the sets of microphones.

8. A device for automated setting of digital processing parameters intended to be applied to digital signals before broadcast by at least one loudspeaker of a plurality of loudspeakers placed in an environment, said device being characterised in that it includes:

means for determining a set of frequency responses of the environment, each of the frequency responses being determined by activating a respective subset of said plurality of loudspeakers; and means for determining, for each respective subset, filter parameters to be applied to the loudspeakers of each respective subset so as to minimise a deviation between a predetermined target frequency response and the frequency response associated to each respective subset of loudspeakers;

means for applying a phase-shift during which at least one delay τ is applied to at least one subset; and means for applying a gain to the at least one subset;

wherein a secondary target frequency response curve RF,c' is determined as follows:

$$_\mathrm{RF}, c'(f) = \begin{cases} 2RF, c(f) - RF(f) & \text{if } RF(f) - RF, c(f) \geq S \\ RF, c(f) & \text{otherwise} \end{cases}$$

where f refers to the frequency, Rf,c is the target frequency response, RF the frequency response measured with all loudspeakers being active, the filter parameters determined, as well as the at least one delay τ and the gain determined at the phase-shift and gain application steps being applied to sine sweep type signals broadcast by the loudspeakers, and S referring to a positive threshold value.

* * * * *